US007047693B2

(12) United States Patent
Lundahl

(10) Patent No.: US 7,047,693 B2
(45) Date of Patent: May 23, 2006

(54) MULTI-COIL SPRING WINDOW COUNTERBALANCE ASSEMBLY

(75) Inventor: Dave B. Lundahl, Fort Collins, CO (US)

(73) Assignee: Inovadeas, LLLP, Fort Collins, CO (US)

( * ) Notice: Subject to any disclaimer, the term of this patent is extended or adjusted under 35 U.S.C. 154(b) by 0 days.

(21) Appl. No.: 10/990,639

(22) Filed: Nov. 16, 2004

(65) Prior Publication Data

US 2005/0132653 A1 Jun. 23, 2005

Related U.S. Application Data

(60) Provisional application No. 60/530,113, filed on Dec. 17, 2003.

(51) Int. Cl.
*E05F 1/00* (2006.01)

(52) U.S. Cl. ..... 49/447; 16/197; 49/506

(58) Field of Classification Search ..... 49/445, 49/446, 448, 506; 16/197
See application file for complete search history.

(56) References Cited

U.S. PATENT DOCUMENTS 4,935,987 A * 6/1990 Sterner, Jr. ..... 16/198
5,353,548 A * 10/1994 Westfall ..... 49/446
6,606,761 B1 * 8/2003 Braid et al. ..... 16/197
6,848,148 B1 * 2/2005 Braid et al. ..... 16/197
2002/0104189 A1 * 8/2002 Braid et al. ..... 16/197
2002/0116786 A1 * 8/2002 Guillemet et al. ..... 16/197

OTHER PUBLICATIONS

Doug Wegman, "The Basics of Window Balance Selection," Window & Door, May 2004, pp. 42-49.
Steve Jordan, "Spring Balances Bounce Back," Old-House Journal, Mar./Apr. 2004, pp. 33-36.
Product Design & Development, Inc, "Product Design's Updated 1997 Catalog".

* cited by examiner

*Primary Examiner*—Jerry Redman
(74) *Attorney, Agent, or Firm*—Cochran Freund & Young LLC; William W. Cochran

(57) ABSTRACT

Disclosed is a multi-coil spring assembly that is mounted in the weight pocket of a vertically operating window. The multi-coil spring assembly allows the user to connect any desired number of coil springs to the counterbalance connector to provide the desired amount of counterbalance force to the sash of a vertically operating window. The multi-coil spring assembly rotates into an interior portion of the window to allow simple and easy connection to the counterbalance connector and then retracts into the weight pocket in a recessed position for normal operation.

6 Claims, 9 Drawing Sheets

MULTI-COIL SPRING WINDOW COUNTERBALANCE ASSEMBLY

CROSS REFERENCE TO RELATED APPLICATIONS

This application claims benefit of and priority to U.S. Provisional Patent Application Ser. No. 60/530,113 entitled "Multi-Coil Spring Window Counterbalance" by Dave B. Lundahl, filed Dec. 17, 2003, the entire contents of which are specifically incorporated herein by reference for all that it discloses and teaches.

BACKGROUND OF THE INVENTION a. Field of the Invention

The present invention pertains generally to windows with vertically operating sashes and more particularly to counterbalance devices for the sash of vertically sliding windows.

b. Description of the Background

Counterbalance mechanisms have been used for the sash of vertically sliding windows for a substantial period of time. Many of the previous techniques of counterbalancing have used counterbalance weights that are connected by ropes, cords, ribbons, bands, chains, etc. ("connectors") to the sash of the window. The purpose of the counterbalance is to provide a sufficient upward force that counterbalances the weight of the sash so that the sash can be easily lifted and maintained in a stationary position.

Many problems exist with these types of counterbalanced mechanisms. For example, oftentimes the connector breaks rendering the counterbalance mechanism ineffective. If the connector breaks when the window is in a closed position and the weight is sufficiently heavy, the weight can fall down through the weight pocket, through the bottom of the window frame and into the wall. Fixing such systems may be difficult. For example, counterbalances that have the desired weight and that are capable of fitting through the opening of the weight pocket may not be readily available. In other words, prior art devices have not provided an easy way of adjusting the counterbalance force to an optimum level for sashes in a weight and pulley counterbalance vertically operating window system. In addition, it may be difficult to assemble these heavy counterbalance weights when attempting repair. Also, replacement of broken ropes or chains may be difficult. Further, if a window is broken, lighter or heavier glass may be used to replace the broken glass which, in turn, will cause the original counterbalance weight to improperly counterbalance the new weight of the sash. Hence, accurately selecting the correct counterbalance force and providing an adjustable manner of counterbalancing the weight of the sash with historic weight and pulley counterbalance vertically operating window systems, has previously been difficult. In addition, with heavy sashes, counterbalance weights typically require a diameter that is too large to fit into the opening of the window frame to provide sufficient counterbalance weight. If the necessary counterbalance weight is achieved with a smaller diameter, it will necessarily be longer to be of an adequate and effective weight to counterbalance a heavy sash. These longer weights significantly reduce the amount of travel of the sash because the longer weight will contact the bottom of the window frame, resulting in restricted opening of the window sash.

SUMMARY OF THE INVENTION

The present invention overcomes the disadvantages and limitations of the prior art by providing a multi-coil spring assembly that can be easily installed in new windows or retrofit into older windows and provides an adjustable counterbalance force to fit a variety of different size windows. In addition, the present invention provides a simple and easy-to-use mechanism for attaching the desired number of multi-coil springs to the connector, that is used in a pulley and weight counterbalance system, that is safe and easy to employ.

The present invention may therefore comprise a counterbalance system for a vertically operating window comprising: a mounting bracket; a plurality of coil springs mounted to the mounting bracket that allow the coil springs to extend from the mounting bracket and generate a force; a counterbalance connector attached to a sash of the vertically operating window; at least one connector that connects a selected number of the plurality of coil springs to the counterbalance connector, the selected number being selected to provide a desired counterbalance force for the sash; a pulley on which the connector travels, the pulley disposed to engage the connector between the sash and the plurality of coil springs; a pivot pin connected to the mounting bracket and mounted in a weight pocket opening in the window frame so that the mounting bracket can be swiveled out of the weight pocket to a position where the counterbalance connector can be connected to the coil springs, and into the weight pocket to a recessed position which allows the sash to be operated in the window frame.

The present invention may further comprise a method of counterbalancing a sash in a vertically operating window comprising: providing a multi-coil spring assembly that has a plurality of coil springs that are mounted on a bracket such that each of the plurality of coil springs provides an individual counterbalance force when uncoiled from the bracket; mounting the multi-coil spring assembly in a recessed position in a weight pocket of the vertically operating window so that multi-coil spring assembly does not interfere with the operation of the sash; providing a swivel that allows the multi-coil spring assembly to be rotated from the weight pocket so that the coil springs can be attached to a counterbalance connector so that a desired amount of counterbalance force can be exerted on the counterbalance, that is attached to the sash, to offset the weight of the sash.

Advantages of the present invention include, but not by way of limitation as to interpretation of the claims, the ability to select the desired counterbalance force by selecting the optimum combination of coil spring strength and number of coil springs that are attached to the connector. In addition, the multi-coil spring assembly is easily rotated out of the weight pocket so that the counterbalance connector can be simply and easily connected with hooks to the desired number of multi-coil springs in an easily accessible manner. Since the multi-coil spring assembly rotates out of the weight pocket into an accessible open position, the need is eliminated for attempting to hook springs or weights to the connector inside the weight pocket, which can be a difficult and unsafe task. Servicing of the mechanism can be performed by a single individual as a result of the unique design of the present invention. In addition, the system is hidden within the weight pocket so that the window maintains an aesthetic appearance while still providing the serviceability and functionality of the system. Since each spring only provides a small predetermined force, e.g., 3 to 10 pounds, the springs can be attached in a safe and easy manner without risk of injury.

DETAILED DESCRIPTION OF THE INVENTION

Figure 1:
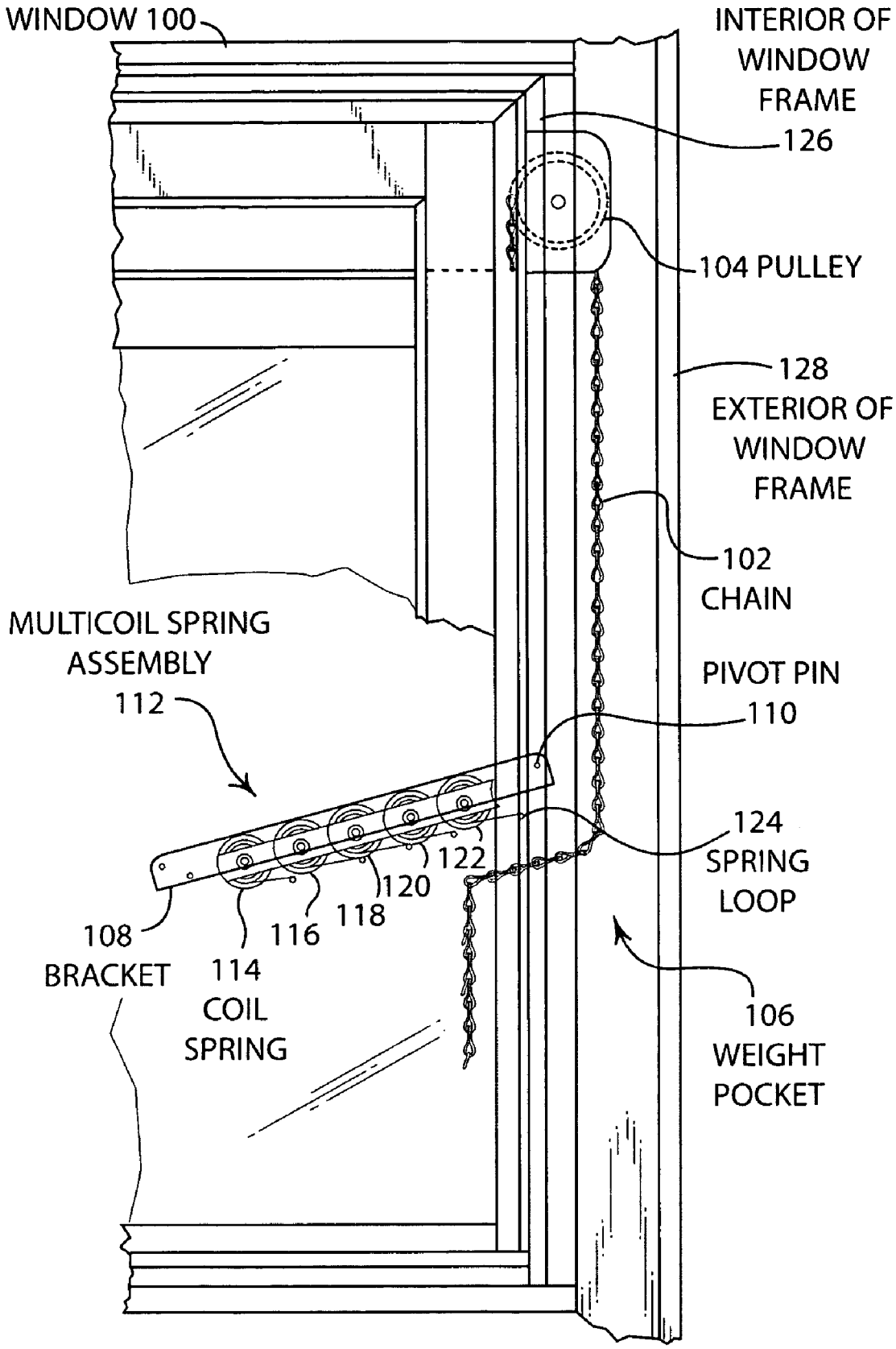
FIG. 1 is a side cut-away view of one embodiment of the invention.

FIG. 1 is a side view of a window frame in which a multi-coil spring window counterbalance assembly 112 is mounted. As shown in FIG. 1, the multi-coil spring assembly 112 is mounted in the frame of window 100 by a pivot pin 110. The multi-coil spring assembly 112 is shown pivoted inwardly into the sash channel area, i.e., towards the interior of the window 100. A connector 102 is wrapped around a pulley 104. The connector 102 attaches to the top of the sash (not shown) of the vertically operating window 100. The connector 102 and the pulley 104 are mounted in the weight pocket 106 of the vertically operating window. The weight pocket is a space that exists between an exterior portion 128 of the window frame and an interior portion 126 of the window frame that houses traditional lead or steel counterbalance weights.

The multi-coil spring assembly 112, illustrated in FIG. 1, includes a number of coil springs 114, 116, 118, 120, 122 that are mounted on a bracket 108. The coil springs 114–122 are mounted so that each of the coil springs can uncoil to generate a substantially linear spring force when attached to connector 102, as described below. The bracket 108 is mounted in the interior portion of the window frame 126 with a pivot pin 110 which allows the bracket 108 to swivel, as shown in FIG. 1, into the sash channel area (interior portion 126) of the window 100, as described above. With the bracket pivoted into the sash channel area of the window, the connector, such as a chain 102, can be connected and disconnected to the coil springs 114–122 in a simple and easy manner. Spring loop 124 is used to attach the coil springs 114–122 to the chain 102, as described in more detail below. As indicated above, the coil springs 114–122 each provide a substantially linear force that is cumulative when attached to the chain 102. For example, each spring may be selected to provide a counterbalance force of one to ten pounds which may vary in one pound increments. The bracket 108 can contain any desired number of multi-coil springs, such as the collection five multi-coil springs 114–122. The user may select the amount of force that is needed to adequately and accurately counterbalance the weight of the sash by selecting the optimum combination of spring strength and number of springs so that the window may be easily raised and lowered. While the bracket and pulley selection enables a much closer matching of counterbalance force to sash weight, any small remaining difference is easily accommodated by friction created between the sash and window frame. The number of springs can be pre-calculated by determining the weight of the sash and attaching the number of springs having the cumulative amount of force that closely matches the weight of the window sash. Alternatively, this process can be performed empirically by attaching a fewer or greater number of springs until the optimum operational characteristics are achieved. Since the multi-coil springs 114–122 can be easily attached or disconnected from the chain 102, such a trial and error method can be easily performed.

Figure 2:
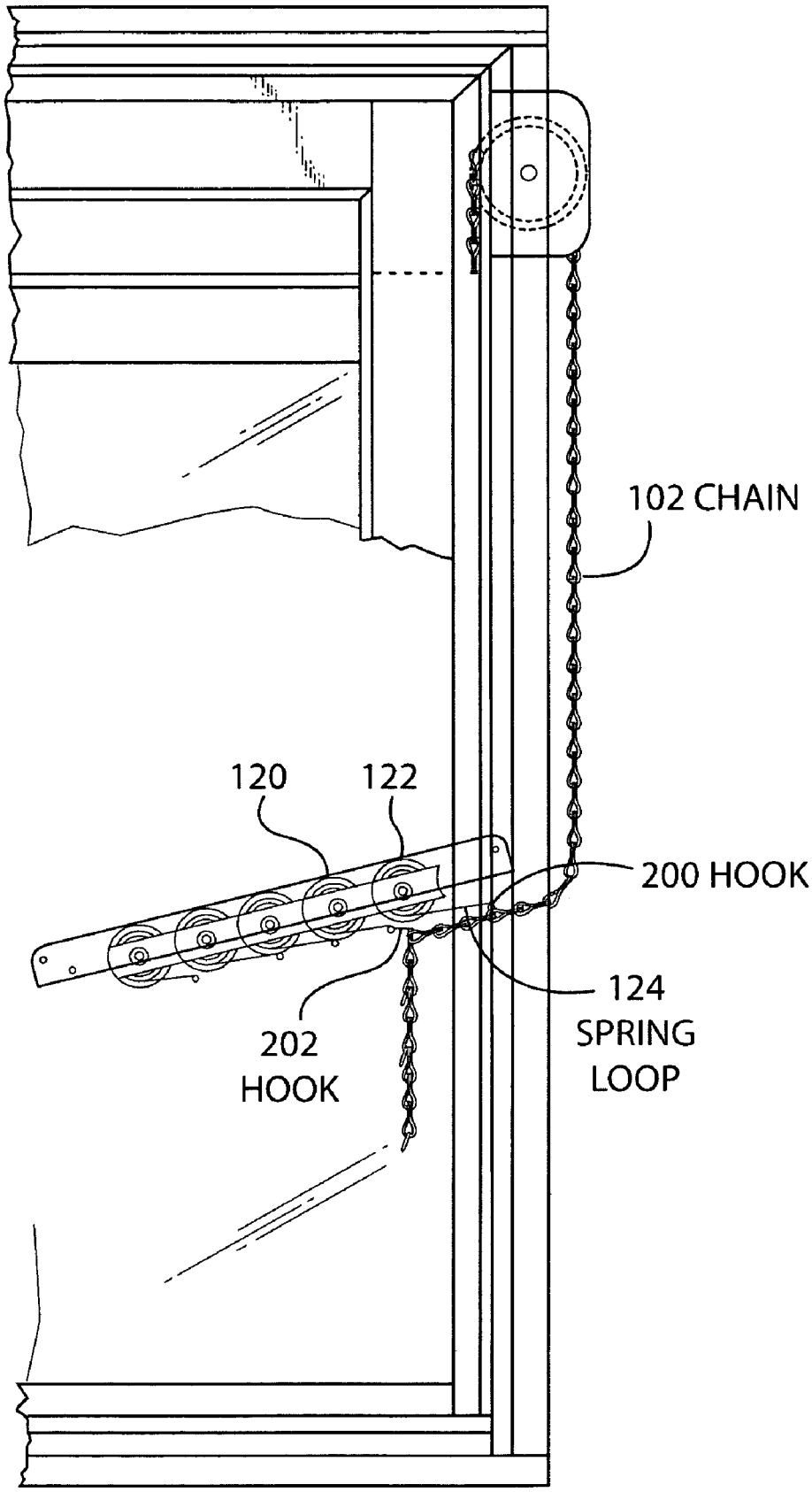
FIG. 2 is an additional view of the embodiment of FIG. 1.

FIG. 2 is another view of the embodiment of FIG. 1. As shown in FIG. 2, coil spring 122 is attached to the chain 102 using a hook 200. Similarly, coil spring 120 is hooked to chain 102 using a hook 202. The hooks 200, 202 are designed for easy attachment and disconnection from the chain 102. Each of the springs 120, 122 provide a predetermined force that is sufficiently low to allow the user to easily pull the spring outward from the coil so that the hooks can be easily attached to or disconnected from the chain 102, without danger to the user. The hooks are also designed with sufficient retainer portions to prevent unintentional disengagement from the chain and spring coil. Hook 200 may hook to any desired portion of the chain to which the hook can engage the chain. Hook 200 also attaches to the spring loop 124 of coil 122 at the opposing end of the hook. Each of the coils 114–120 has a similar spring loop which is adapted to engage the hooks.

Figure 3:
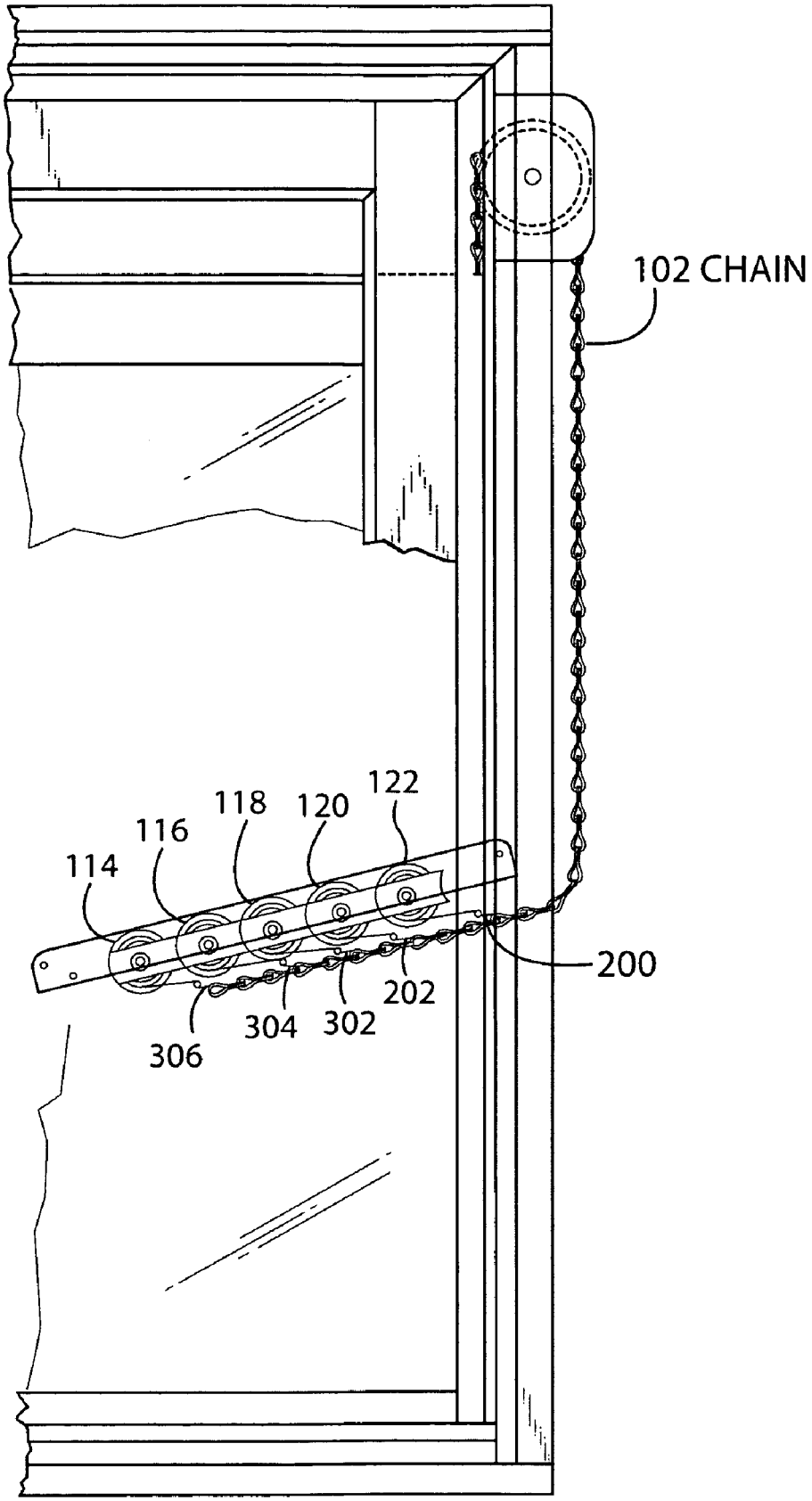
FIG. 3 is an additional view of the embodiment of FIG. 1.

FIG. 3 is an additional view of the embodiment of FIG. 1. As shown in FIG. 3, each of the coil springs 114–122 is attached to the chain 102. Hooks 200, 202, 302, 304, 306 connect the coil springs 122, 120, 118, 116, 114, respectively, to the chain 102. Hence, the downward force generated on chain 102 when the coil springs 114–122 are engaged is the cumulative force of each of the coil springs 114–122. For example, if each of the coil springs 114–122 provides a force of 8 pounds, the cumulative force on the chain 102 for the five springs is 40 pounds. If a pulling force of 35 pounds is desired, it can be achieved with the selection of 4 coils that each create 8 pounds of pulling force and 1 coil with 3 pounds of pulling force. In other words, each of the coils can be selected to provide a specific amount of force to create the desired amount of overall force. In this fashion, the desired amount of overall force can be generated on the chain 102 by attaching the desired number of coil springs to the chain and selecting coils with a specified amount of pulling force.

Figure 4:
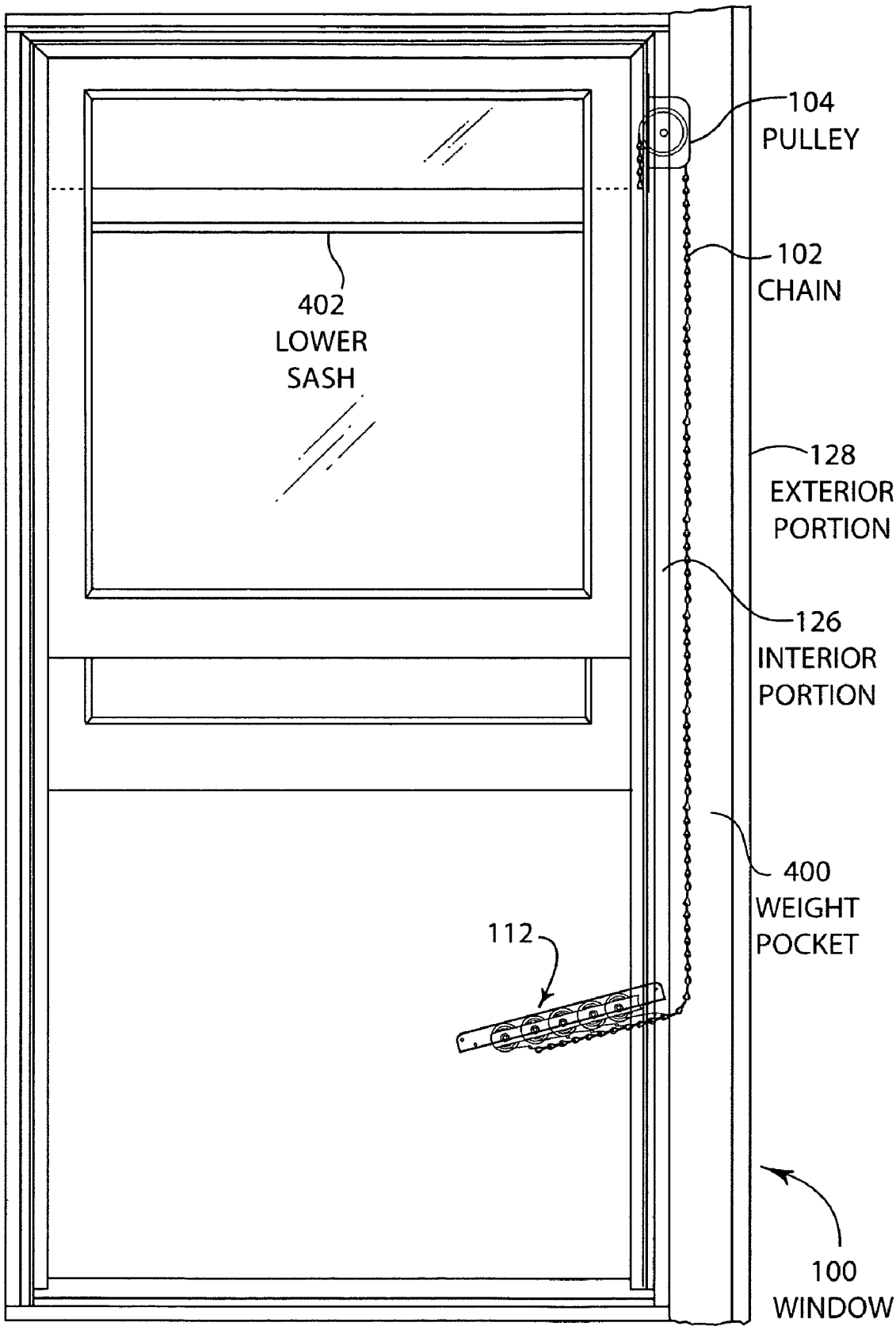
FIG. 4 is an additional view of the embodiment of FIG. 1.

FIG. 4 is an additional view of the embodiment of FIG. 1 showing the entire window frame. As illustrated in FIG. 4, the chain 102 is disposed in the weight pocket 400. The weight pocket 400 is formed between the exterior portion 128 and the interior portion 126 of the window frame. The chain proceeds upwardly and around the pulley 104 and is attached to the sash 402. The other end of the chain proceeds through an opening in the weight pocket 400 (described below) and is attached to the multi-coil spring assembly 112 which is shown in a swiveled inwardly position, into the sash channel interior portion of the window 100, for easy attachment to the chain 102.

Figure 5:
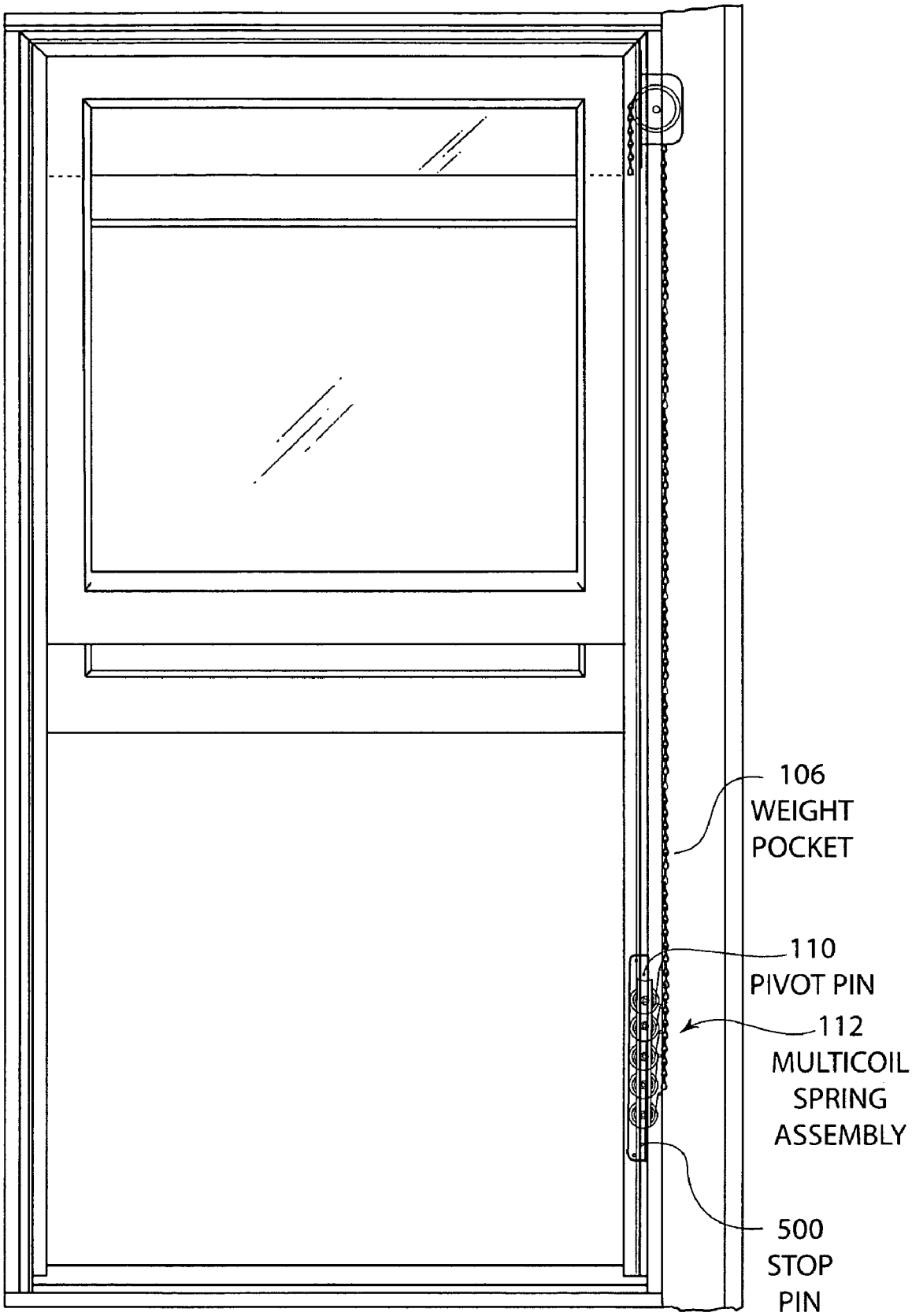
FIG. 5 is still another view of the embodiment of FIG. 1.

FIG. 5 is an additional view of the embodiment of FIG. 1. As shown in FIG. 5, the multi-coil spring assembly 112 is shown in a retracted position in the weight pocket 106 so that the multi-spring coil assembly is clear of the channel of the window frame in which the sash operates. The multi-coil spring assembly 112 pivots around the pivot pin 110 to the retracted position. A stop pin 500 rests within a recessed portion of the window frame so that the multi-coil spring assembly 112 does not retract farther than desired into the weight pocket 106.

Figure 6:
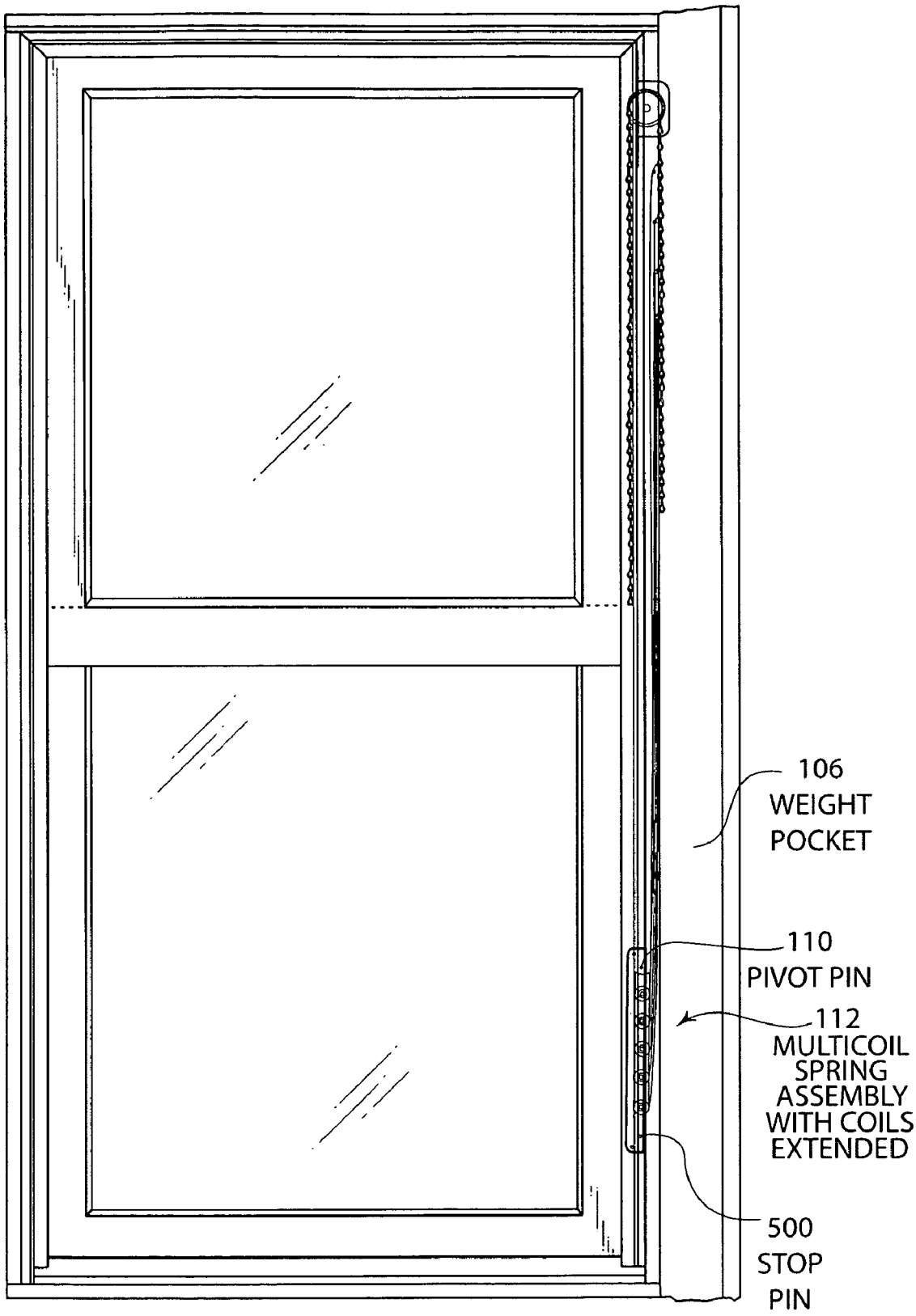
FIG. 6 is still an additional view of the embodiment of FIG. 1.

FIG. 6 is a schematic illustration of the embodiment of FIG. 1 showing the window sash in a fully closed (down)

position. As shown in FIG. 6, the coil springs are extended and proceed upwardly through the weight pocket 106 as the connector is pulled downwardly by the window sash.

Figure 7:
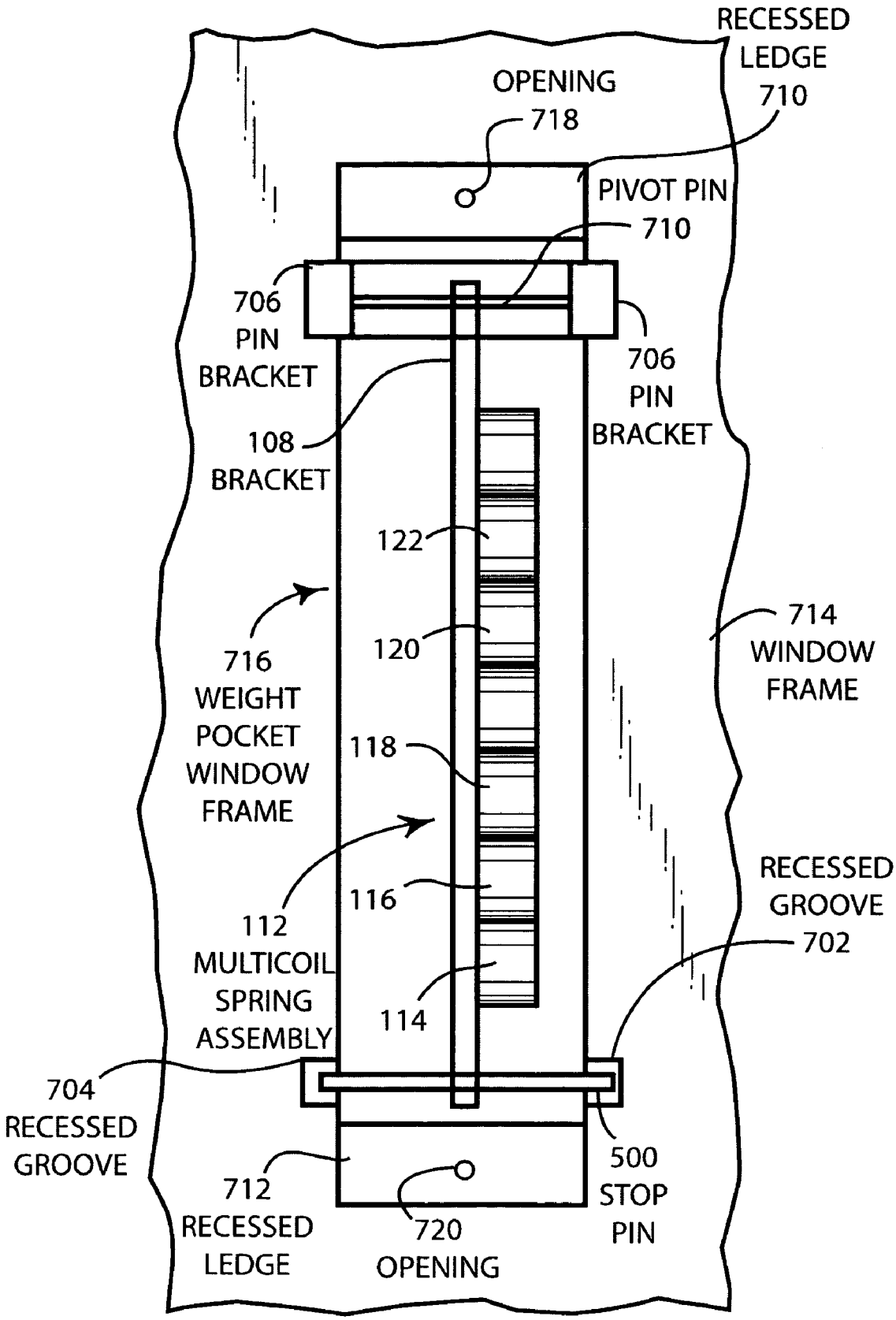
FIG. 7 is a side view of the multi-coil spring assembly inserted in a weight pocket.
Figure 8:
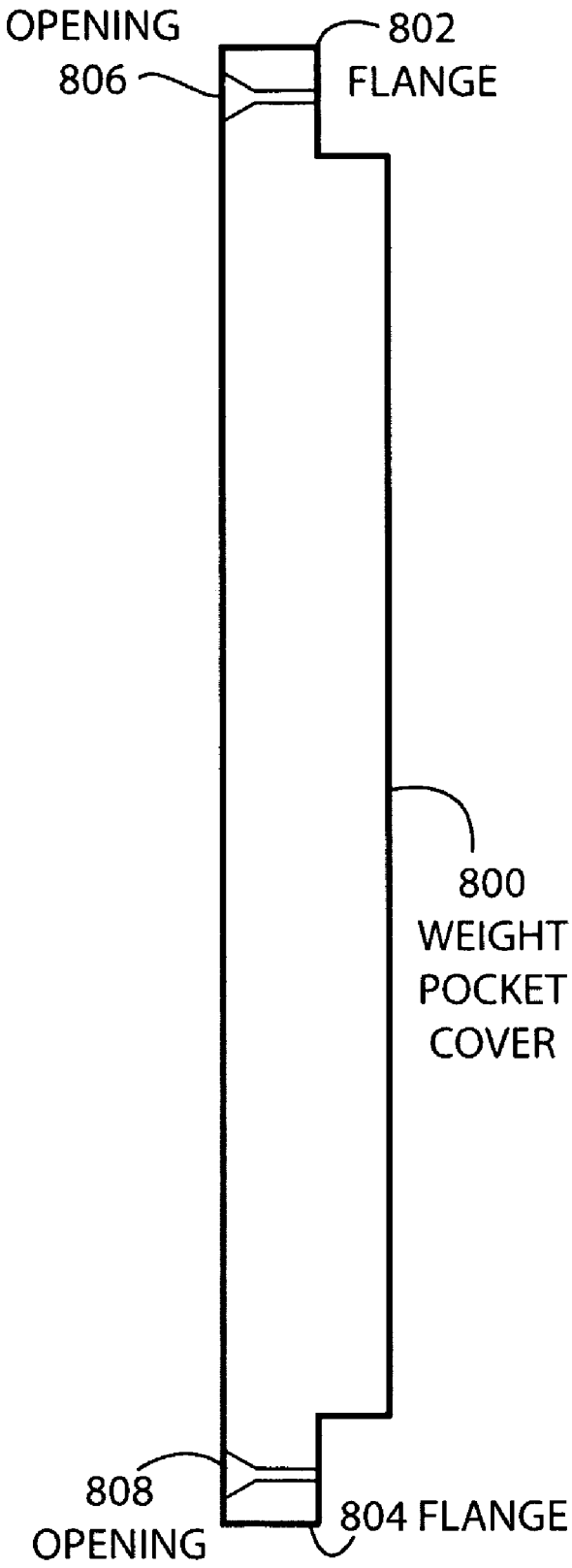
FIG. 8 is a side view of the weight pocket cover.

FIG. 7 is a schematic illustration of an elevation view of the weight pocket 106, of a window jam as viewed from the position of the sash (interior portion) of the window. As shown in FIG. 7, the window frame 714 has recessed portions 710 and 712 formed therein. The flanges 802, 804 of the weight pocket cover 800, which are shown in FIG. 8, fit into the recessed portions 710, 712. The body of the weight pocket cover 800 covers the opening 716 in the window frame and provides a flush cover for mounting of weather strip and sliding sash (not shown) in the window frame. Openings 806, 808 allow connectors, such as screws, to connect the weight pocket cover 800 to the window frame 714 through openings 718, 720, respectively.

As also shown in FIG. 7, the multi-coil spring assembly 112 is mounted in a recessed position in the opening 716 in the window frame 714. Pin bracket 706 hold the pivot pin 110 in a recessed position in the opening 116. The pin brackets may be made of a thin but strong metal that have a flange portion that mounts on the outer surface of the window frame 114, is bent around the edge of the opening 116 and proceeds to the interior recessed portion of the opening 116 to hold the pivot pin 110 in a recessed position. This is explained in more detail with respect to the description of FIG. 8. In this fashion, the weight pocket cover 800 can fit flush to the window frame 714. The flanges on the pin bracket 706 only protrude slightly outwardly from the face of the window frame 114 or can be recessed slightly into the window frame. In any event, the weather strip and sliding sash (not shown) easily fit over this portion of the window frame 714 and allow the sash to slide over this area. Also, pin bracket 706 is mounted flush against the edge of the recessed ledge 710 to provide additional support to the pin bracket 706.

As also shown in FIG. 7, a stop pin 500 is connected to the bracket 108. When the multi-coil spring assembly 112 is mounted in the window frame 714 in a recessed position, the stop pin 500 rests in the window frame in the recessed grooves 702, 704. The recessed grooves 702, 704 are sufficiently deep to allow the multi-coil spring assembly to mount in a recessed position in the window frame 714, such as illustrated in FIG. 5. When the stop pin 500 is abutted against the window frame in the recessed grooves 702, 704, sufficient support is provided for the bracket 108 so that the coils 114–122 can be extended.

Figure 9:
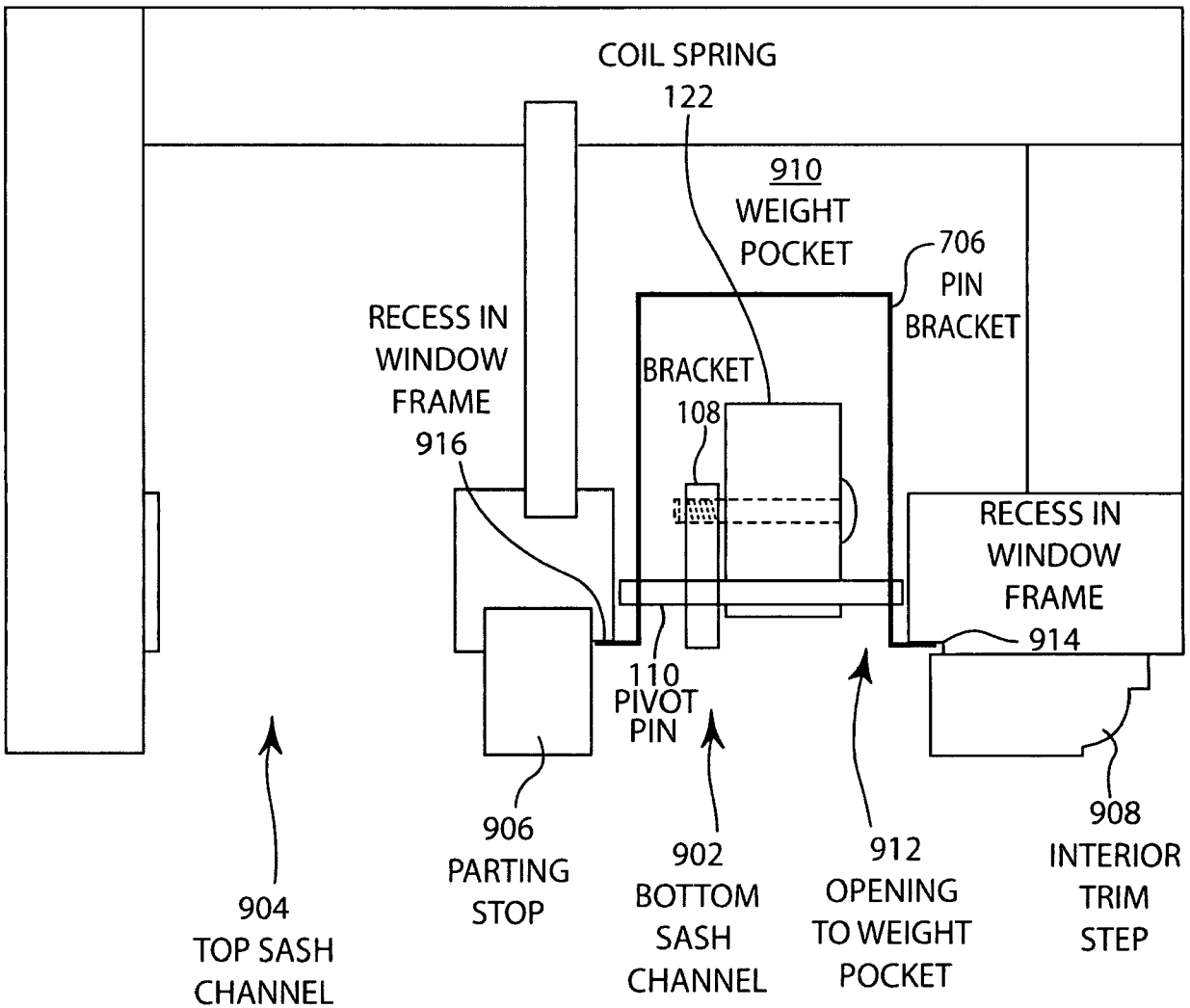
FIG. 9 is a section view illustrating the manner in which the pin bracket is mounted to the window frame.

FIG. 9 is a section view illustrating the right jam as viewed from the top interior portion of the window. FIG. 9 illustrates the bottom sash channel 902 and the top sash channel 904. Disposed between the bottom sash channel 902 and the top sash channel 904 is a parting stop 906. Interior trim stop 908 forms the other portion of the bottom sash channel 902. As shown in FIG. 9, the bottom sash (not shown) moves up and down in the bottom sash channel 902 in a direction perpendicular to the surface of FIG. 9. FIG. 9 also discloses recesses 914, 916 which are formed in the window frame. Recesses 914, 916 allow the pin bracket 706 to be mounted in the window frame in a recessed portion so that the pin bracket 706 does not interfere with the travel of the bottom sash in the bottom sash channel 902. The pin bracket 706 is fixedly mounted in the weight pocket opening 912 to hold the pivot pin 110 in a fixed position near the top of the opening of the weight pocket 912. Bracket 108 is mounted on the pivot pin 110 so that the bracket 108 and coil spring 122, as well as the other coil springs, can rotate out of the opening to the weight pocket 912 towards the bottom sash channel 902 and into the interior portion of the window for easy accessibility. Hence, the multi-coil spring assembly 112, bracket 108, pivot pin 110 and pin bracket 706 are all recessed within the weight pocket 910 and the opening to the weight pocket 912 during normal operation of the sash. Also, the structure shown in FIG. 9 allows the bracket 108 to be rotated to an easily accessible position for connection of the multi-coil spring assembly 112 to the chain 102, as shown in FIG. 1.

The present invention therefore provides a novel and unique system for counterbalancing a sash in a vertically operating window. Existing vertically operating windows can be retrofit with the present invention. In addition, new windows can be constructed using the present invention. The present invention allows the counterbalance connector to be attached to the multi-coil spring assembly in a simple and easy fashion by simply rotating the multi-coil spring assembly to the interior sash channel portion of the window. In addition, the desired counterbalance force can be selected by simply attaching the optimum combination of coil spring strength and number of coil springs to the connector which allows the user to select the desired amount of counterbalance force.

The foregoing description of the invention has been presented for purposes of illustration and description. It is not intended to be exhaustive or to limit the invention to the precise form disclosed, and other modifications and variations may be possible in light of the above teachings. For example, in FIG. 2, the spring loop 124 of each coil 122 might be formed differently so as to permit the end of each coil to connect directly to the chain 102 and eliminate the use of the hook 200. In addition, if other types of connectors are used, such as bands or ribbons, other ways of connecting the spring directly to the band or ribbon can be used. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A counterbalance system for a vertically operating window comprising:

a mounting bracket;

a plurality of coil springs mounted to said mounting bracket that allow said coil springs to extend from said mounting bracket and generate a force;

a counterbalance connector attached to a sash of said vertically operating window;

at least one connector that connects a selected number of said plurality of coil springs to said counterbalance connector, said selected number being selected to provide a desired counterbalance force for said sash;

a pulley on which said connector travels, said pulley disposed to engage said connector between said sash and said plurality of coil springs;

a pivot pin connected to said mounting bracket and mounted in a weight pocket opening in said window frame so that said mounting bracket can be swiveled out of said weight pocket to a position where said counterbalance connector can be connected to said coil springs, and back into said weight pocket to a recessed position which allows said sash to be operated in said window frame.

2. The counterbalance system of claim 1 further comprising:

a stop pin connected to said bracket that rests in a recessed portion of said window frame and maintains said mounting bracket in said recessed position.

3. The counterbalance system of claim 2 further comprising:

a pin bracket that is mounted in a recessed portion of said window frame that mounts the pivot pin in said weight pocket.

4. A method of counterbalancing a sash in a vertically operating window comprising:

providing a multi-coil spring assembly that has a plurality of coil springs that are mounted on a bracket such that each of said plurality of coil springs provides an individual counterbalance force when uncoiled from said bracket;

mounting said multi-coil spring assembly in a recessed position in a weight pocket of said vertically operating window so that multi-coil spring assembly does not interfere with the operation of said sash;

rotating said multi-coil spring assembley about a pivot pin from said weight pocket so that said coil springs can be attached to a counterbalance connector so that a desired amount of counterbalance force can be exerted on said counterbalance, that is attached to said sash, to offset the weight of said sash.

5. The method of claim 4 further comprising:

selecting a desired combination of coil strength and number of coil springs of said plurality of coil springs to create said desired amount of counterbalance force.

6. The method of claim 5 further comprising:

attaching said desired combination of coil springs to said counterbalance connector to generate said desired amount of counterbalance force to counterbalance said shaft.

* * * * *